US007222616B2

(12) United States Patent
Takeyama et al.

(10) Patent No.: US 7,222,616 B2
(45) Date of Patent: May 29, 2007

(54) STICK IGNITION COIL APPARATUS FOR IGNITION PLUG

(75) Inventors: Shouichi Takeyama, Hashima (JP); Masahiko Aoyama, Kariya (JP); Kazuhide Kawai, Kariya (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 11/181,895

(22) Filed: Jul. 15, 2005

(65) Prior Publication Data

US 2006/0021608 A1 Feb. 2, 2006

(30) Foreign Application Priority Data

Jul. 27, 2004 (JP) ..... 2004-218737
May 25, 2005 (JP) ..... 2005-152985

(51) Int. Cl.
*H01F 38/12* (2006.01)
*F02P 3/02* (2006.01)

(52) U.S. Cl. ..... 123/634; 123/635

(58) Field of Classification Search ..... 123/634, 123/635, 143 A, 143 B, 143 R; 336/15, 336/128

See application file for complete search history.

(56) References Cited

U.S. PATENT DOCUMENTS 5,870,012 A 2/1999 Sakamaki et al. ..... 336/107
6,332,458 B1 * 12/2001 Shimada et al. ..... 123/634

FOREIGN PATENT DOCUMENTS

JP 2000-133534 5/2000

* cited by examiner

*Primary Examiner*—Johnny H. Hoang
(74) *Attorney, Agent, or Firm*—Nixon & Vanderhye PC

(57) ABSTRACT

A stick ignition coil apparatus for an ignition plug includes a primary coil arrangement, a secondary coil arrangement, a center core, a coil case, a high voltage terminal, a spring case and dielectric resin. The primary coil arrangement is located radially outward of the secondary coil arrangement, which is located radially outward of the center core. The coil case is located radially outward of the primary coil arrangement. The high voltage terminal is located at a distal end of the secondary coil arrangement. The spring case holds a spring. The dielectric resin is filled in a space defined radially inward of the coil case. An open end of the high voltage terminal is connected to an annular corner portion of a distal projecting portion of a secondary spool of the secondary coil.

16 Claims, 10 Drawing Sheets

STICK IGNITION COIL APPARATUS FOR IGNITION PLUG

CROSS REFERENCE TO RELATED APPLICATION

This application is based on and incorporates herein by reference Japanese Patent Applications No. 2004-218737 filed on Jul. 27, 2004 and No. 2005-152985 filed on May 25, 2005.

BACKGROUND OF THE INVENTION

1. Field of the Invention

The present invention relates to a stick ignition coil apparatus for an internal combustion engine.

2. Description of Related Art

A stick ignition coil apparatus includes a center core, an outer core, a primary coil arrangement and a secondary coil arrangement. By switching on and off of supply of an electric current to the primary coil arrangement, a high voltage is generated in the secondary coil arrangement. The high voltage, which is generated at the secondary coil arrangement, is supplied to an ignition plug by way of a high voltage terminal, which is located at a (lower) end of the secondary coil arrangement.

As shown in FIG. 23A, a conventional stick ignition coil apparatus has a coil case 300, which includes a center core 302, a secondary coil arrangement 304, which is located radially outward of the center core 302, and a primary coil arrangement 308, which is located radially outward of the secondary coil arrangement 304. The secondary coil arrangement 304 includes a secondary spool 305 and a secondary winding 306, which is wound around the secondary spool 305. The primary coil arrangement 308 includes a primary spool 309 and a primary winding 310, which is wound around the primary spool 309.

A terminal plate (a second terminal element) 317, which is shaped into a tubular form, is installed at a bottom end of the secondary spool 305. A tubular-form high voltage terminal (a first terminal element) 315, an opening of which faces downward, is held in a spring case 312, which holds a spring 313. The spring 313 is located between the high voltage terminal 315 and the ignition plug (not shown). An upwardly extending portion of the high voltage terminal 315 contacts the terminal plate 317. Therefore, a bottom end of the secondary winding 306 is connected with the ignition plug, by way of the terminal plate 317, the high voltage terminal 315 and the spring 313. A space, which is formed by a bottom end of the coil case 300, the spring case 312, the high voltage terminal 315 and the like, is filled with dielectric resin 319 (see Unexamined Japanese Patent Publication No. 2000-133534).

However, in the above-described conventional art, a crack may be formed on the dielectric resin 319. Here, the terminal plate 317, which is a copper alloy, such as phosphor bronze, does not adhere well to the dielectric resin 319, which is made of a thermosetting epoxy resin. Furthermore, a coefficient of linear thermal expansion of the terminal plate 317 differs from that of the dielectric resin 319. Therefore, as shown in FIG. 23B, when a thermal stress is generated in a radial direction at the time of starting and stopping of an engine, and the crack tends to be formed at a phase boundary 321 between the terminal plate 317 and the dielectric resin 319.

An edge effect of the terminal plate 317 is added to the crack at the phase boundary. This means that the thermal stress is concentrated around an edge 317*a* and a resin portion therearound. Then, the dielectric resin 319 gets the crack 322, which starts from the edge 317*a* of the terminal plate 317. This may cause a dielectric breakdown.

SUMMARY OF THE INVENTION

The present invention addresses the above disadvantages. Thus, it is an objective of the present invention to provide a stick ignition coil apparatus, which limits generation of cracks in a dielectric resin (a potting material) of the stick ignition coil apparatus.

To achieve the objective of the present invention, there is provided a stick ignition coil apparatus for an ignition plug including a primary coil arrangement, a secondary coil arrangement, a center core, a coil case, a high voltage terminal, a spring case and dielectric resin. The primary coil arrangement includes a primary winding and a primary spool, wherein the primary winding is wound around the primary spool. The secondary coil arrangement is located radially inward of the primary coil arrangement, wherein the secondary coil arrangement includes a secondary winding and a secondary spool, the secondary winding is wound around the secondary spool, and an annular corner portion is formed on a distal projecting portion of the secondary spool. The center core is located radially inward of the secondary coil arrangement. The coil case is located radially outward of the primary coil arrangement. The high voltage terminal is located at a distal end of the secondary coil arrangement, wherein the high voltage terminal is shaped into a tubular form, an opening of which faces toward a proximal end of the stick ignition coil apparatus, and the high voltage terminal is electrically connected with one end of the secondary winding. The spring case holds a spring for electrically connecting the high voltage terminal with the ignition plug. The dielectric resin is filled in a space defined radially inward of the coil case, wherein an open end of the high voltage terminal is connected to the annular corner portion of the distal projecting portion of the secondary spool.

To achieve the objective of the present invention, there is also provided a stick ignition coil apparatus for an ignition plug including a primary coil arrangement, a secondary coil arrangement, a center core, a coil case, a spring case, a high voltage terminal and dielectric resin. The primary coil arrangement includes a primary winding and a primary spool, wherein the primary winding is wound around the primary spool. The secondary coil arrangement is located radially inward of the primary coil arrangement, wherein the secondary coil arrangement includes a secondary winding and a secondary spool, and the secondary winding is wound around the secondary spool. The center core is located radially inward of the secondary coil arrangement. The coil case is located radially outward of the primary coil arrangement. The spring case is located at a distal side of the coil case, wherein the spring case holds a spring, one end of which contacts the ignition plug to form an electrical connection therebetween. The high voltage terminal is located at a proximal end of a proximal cylindrical end portion of the spring case, wherein the high voltage terminal is shaped into a tubular form, an opening of which faces toward a proximal end of the stick ignition coil apparatus, the high voltage terminal is electrically connected with one end of the secondary winding, and the high voltage terminal is contacts the other end of the spring to form an electrical connection therebetween. The dielectric resin is filled in a space defined radially inward of the coil case, wherein an open end of the high voltage terminal contacts an inner peripheral surface of the proximal cylindrical end portion of the spring case.

To achieve the objective of the present invention, there is also provided a stick ignition coil apparatus for an ignition plug including a primary coil arrangement, a secondary coil arrangement, a center core, a coil case, a spring case, a high voltage terminal and dielectric resin. The primary coil arrangement includes a primary winding and a primary spool, wherein the primary winding is wound around the primary spool. The secondary coil arrangement, which is located radially inward of the primary coil arrangement, wherein the secondary coil arrangement includes a secondary winding and a secondary spool, and the secondary winding is wound around the secondary spool. The center core is located radially inward of the secondary coil arrangement. The coil case is located radially outward of the primary coil arrangement. The spring case is located at a distal side of the coil case, wherein the spring case holds a spring, one end of which contacts the ignition plug to form an electrical connection therebetween, and a proximal cylindrical end portion of the spring case is located at a proximal end of the spring case. The high voltage terminal contacts at least one of a distal end of the secondary coil arrangement and the proximal end of the spring case, wherein the high voltage terminal is shaped into a tubular form, an opening of which faces toward a proximal end of the stick ignition coil apparatus, the high voltage terminal is electrically connected with one end of the secondary winding, and the high voltage terminal contacts the other end of the spring to form an electrical connection therebetween. The dielectric resin is filled in a space defined radially inward of the coil case, wherein an open end of the high voltage terminal is surrounded by a distal projecting portion of the secondary spool and the proximal cylindrical end portion of the spring case.

To achieve the objective of the present invention, there is also provided a stick ignition coil apparatus for an ignition plug including a primary coil arrangement, a secondary coil arrangement, a center core, a coil case, a spring case, a high voltage terminal and dielectric resin. The primary coil arrangement includes a primary winding and a primary spool, wherein the primary winding is wound around the primary spool. The secondary coil arrangement is located radially inward of the primary coil arrangement, wherein the secondary coil arrangement includes a secondary winding and a secondary spool, and the secondary winding is wound around the secondary spool. The center core is located radially inward of the secondary coil arrangement. The coil case is located radially outward of the primary coil arrangement. The spring case is located at a distal side of the coil case, wherein the spring case holds a spring, one end of which contacts the ignition plug to form an electrical connection therebetween. The high voltage terminal is located on a proximal end of the spring case, wherein the high voltage terminal is shaped into a tubular form, an opening of which faces toward a distal end of the stick ignition coil apparatus, the high voltage terminal is electrically connected with one end of the secondary winding, and the high voltage terminal includes a first terminal element, which contacts the other end of the spring to form an electrical connection therebetween. The dielectric resin is filled in a space defined radically inward of the coil case, wherein an open end of the high voltage terminal is located in a space, which is not filled with the dielectric resin.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION (First Embodiment)

Figure 1:
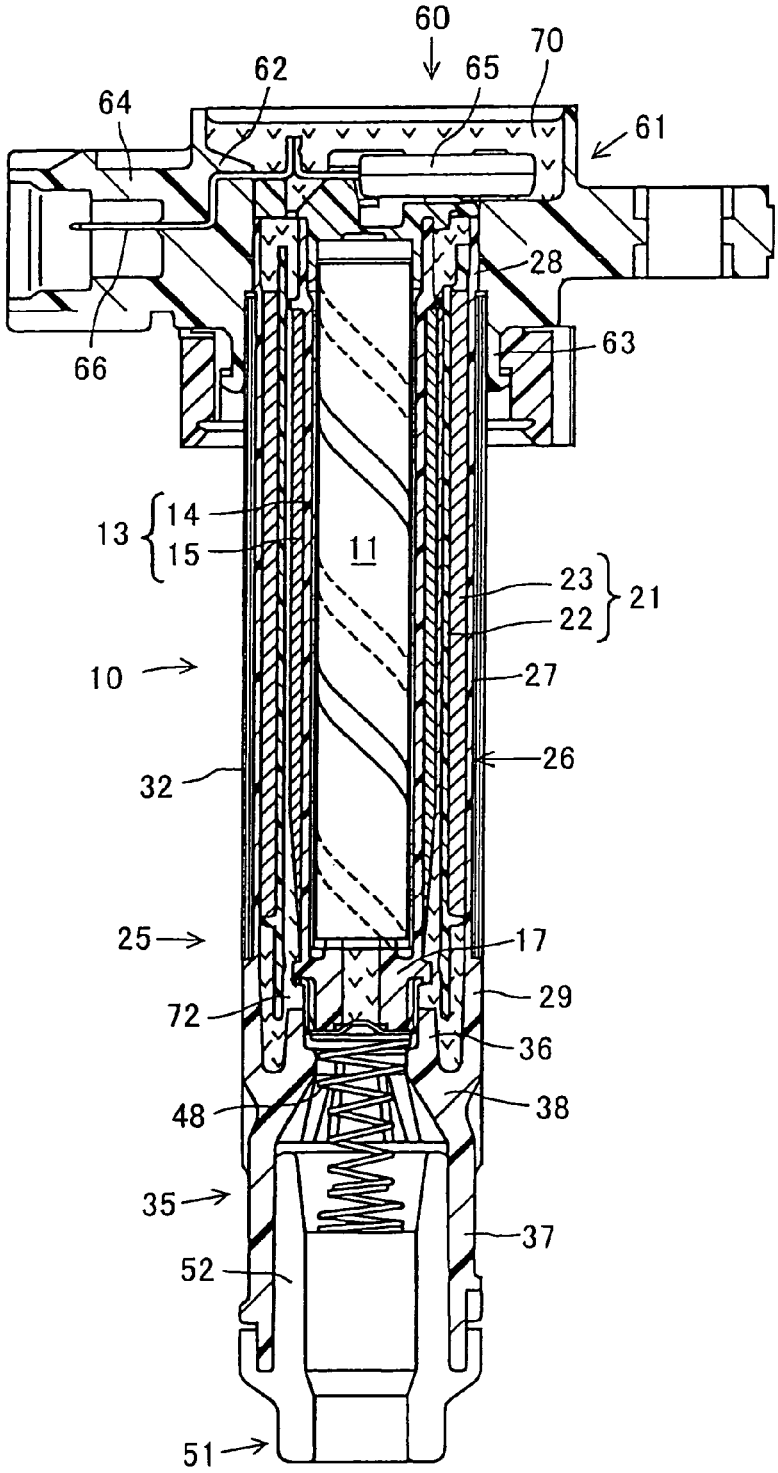
FIG. 1 is a longitudinal sectional view of a stick ignition coil apparatus according to a first embodiment of the present invention.

A structure of a stick ignition coil apparatus according to a first embodiment will be described. As shown in FIG. 1, the stick ignition coil apparatus includes a coil member 10, a high voltage tower member (not shown) and a control member 60. The coil member 10 is located at an axially middle portion of the stick ignition coil apparatus. The high voltage tower member is located at one end (a bottom end) of the stick ignition coil apparatus. The control member 60 is located at the other end (a top end) of the stick ignition coil apparatus. The coil member 10 is inserted into a plug hole (not shown) of an engine head and is connected to an ignition plug (spark plug) through the high voltage tower member (not shown) at the bottom end of the stick ignition coil apparatus. The control member 60 at the top end of the stick ignition coil apparatus is seated against a top surface of an engine head cover.

In the coil member 10, a center core 11, a secondary coil arrangement 13, a primary coil arrangement 21, case 25 and a radially outer core 32 are arranged in this order in a radial direction from a center to a radially outer part of the coil member 10. The center core 11 is made of a magnetic material, and is shaped into a cylindrical bar form. The secondary coil arrangement 13 includes a secondary spool 14 and a secondary winding 15. The secondary spool 14 is dielectric and is formed into a cylindrical body having a bottom. The secondary winding 15 is wound around the secondary spool 14. A bottom cylindrical end portion (a distal cylindrical end portion) 18 is projected from a base portion 17 of the secondary spool 14 (see FIG. 2). The primary coil arrangement 21 is concentrically arranged radially outward of the secondary coil arrangement 13. The primary coil arrangement 21 includes a primary spool 22 and a primary winding 23. The primary spool 22 is dielectric, and is a cylinder. The primary winding 23 is wound around the primary spool 22.

The case 25, which is made of the dielectric material, includes a coil case member 26 and a spring case member 35, which is formed integrally with the coil case member 26. The cylindrical coil case member 26 includes an intermediate portion 27, a top end portion 28 and bottom end portion 29. The radially outer core 32, which has C-shaped cross section, is installed to an outer peripheral surface of the intermediate portion 27 to radially oppose the center core 11. The top end portion 28 of the coil case member 26 is press fitted into a top case 61, which will be described later.

Figure 2A:
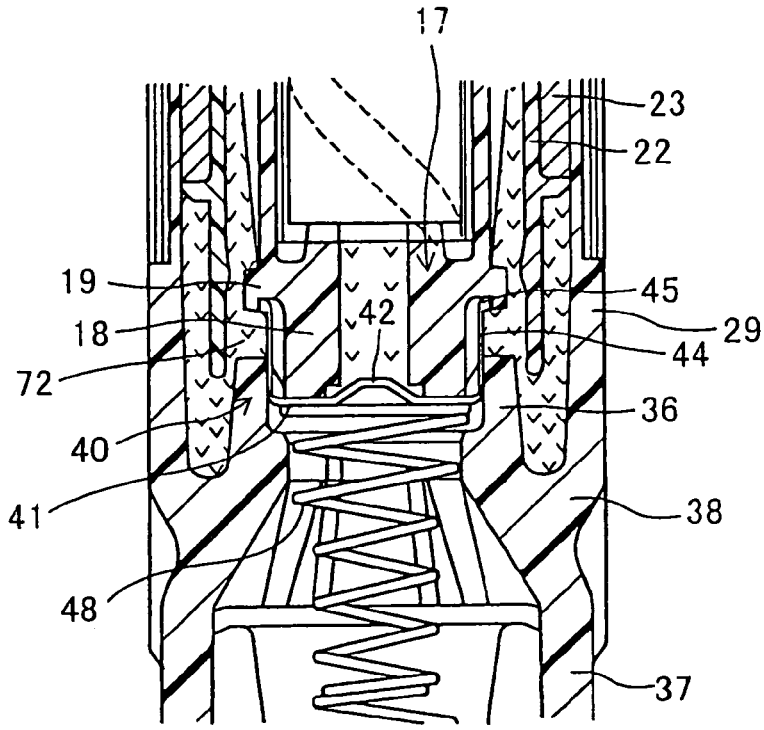
FIG. 2A is an enlarged view of a main part of the stick ignition coil apparatus of FIG. 1.
Figure 2B:
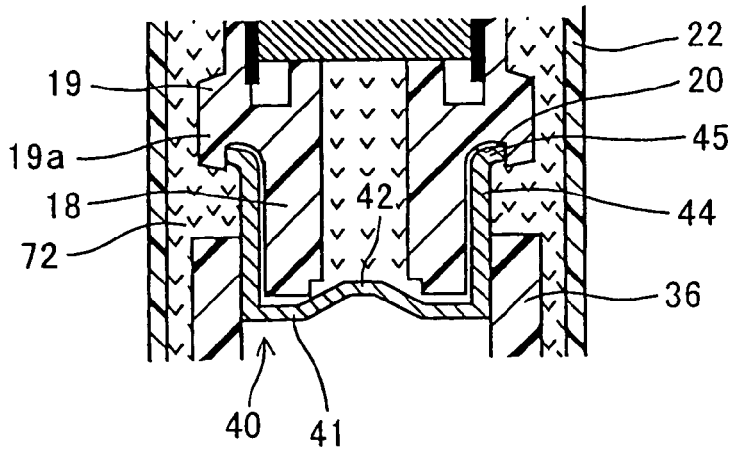
FIG. 2B is a schematic view of FIG. 2A.

FIG. 2A is an enlarged view of a main part of FIG. 1, and FIG. 2B is a schematic view of FIG. 2A. As shown in FIGS. 2A and 2B, the spring case member 35, which is connected to the bottom end portion 29, includes a top cylindrical end portion (a proximal cylindrical end portion) 36, a bottom end holding portion 37 and an intermediate connection portion 38. An inner diameter of the top cylindrical end portion 36 is slightly larger than an outer diameter of the bottom cylindrical end portion 18 of the secondary spool 14. The top cylindrical end portion 36 and the bottom cylindrical end portion 18 are slightly overlapping each other in the axial direction (height direction). Relevant components of FIG. 2A, which directly associate with the present invention, are schematically depicted in FIG. 2B.

A high voltage terminal 40 is located between the bottom cylindrical end portion 18 and the top cylindrical end portion 36. The high voltage terminal 40, which is made by drawing a copper-alloy circular plate material, includes a circular base wall portion 41 and a peripheral wall portion 44, which rises perpendicularly from a rim of the base wall portion 41 and extends upward in the axial direction. At a center of the base wall portion 41, a conic projection 42, which is slightly projecting upward, is formed. A top end of the outer peripheral wall portion 44 of the high voltage terminal 40 extends upward (an opening of the high voltage terminal 40 faces upward) and an open end 45, which is the top end of the outer peripheral wall portion 44, is slightly bent radially outward.

An inner peripheral surface of the peripheral wall portion 44 is engaged with an outer peripheral surface of the bottom cylindrical end portion 18 of the secondary spool 14. The open end 45 contacts an annular corner portion 20, which is composed by the bottom cylindrical end portion 18 and a flange portion 19. An annular projection 19*a*, which axially projects downward, is formed on an outer rim of the flange portion 19. A top surface of the base wall portion 41 contacts a bottom surface of the bottom cylindrical end portion 18. Thus, the conic projection 42 is projected into a cavity of the bottom cylindrical end portion 18. A top end of a spring 48, which is held by the holding portion 37, contacts the base wall portion 41 of the high voltage terminal 40 to form an electrical connection therebetween. Also, a bottom end of the spring 48 is connected resiliently with the ignition plug (not shown) to form an electrical connection therebetween.

In FIG. 1, a bottom press-fitting portion 52, which is located at a top end of a cylindrical plug cap 51 of the high voltage tower member, is press fitted into the holding portion 37. The control member 60 includes the top case 61 and an igniter 65. The top case 61 includes a receiving portion 62, a top press-fitting portion 63, a connecting portion 64 and the like.

First dielectric resin (first potting material) 70 and second dielectric resin (second potting material) 72 are filled in the following spaces: a space between the primary winding 23 and the coil case member 26, which is located radially outward of the primary winding 23, a space between the secondary winding 15 and the primary spool 22, which is located radially outward of the secondary winding 15, a space between the bottom cylindrical end portion 18 of the secondary spool 14 and the top cylindrical end portion 36 of the spring case 35, and a space between the igniter 65 and the receiving portion 62.

A method of assembling the stick ignition coil apparatus will be described. The high voltage terminal 40 is installed on the bottom cylindrical end portion 18 of the secondary spool 14. The center core 11 is inserted into a cavity of the secondary spool 14 from a top opening thereof. Then, a bottom end of the center core 11 contacts the base portion 17 of the secondary spool 14. Then, the center core 11 and the secondary coil arrangement 13 are inserted into a cavity of the primary spool 22.

Thereafter, an integrated member, which includes the center core 11, the secondary coil arrangement 13 and the primary coil arrangement 21, is inserted into the coil case member 26 until the bottom cylindrical end portion 18 of the secondary spool 14 contacts the top cylindrical end portion 36. Before or after this, the radially outer core 32, which has the C-shaped cross section, is installed over the intermediate portion 27 of the coil case 26, by enlarging the lateral opening or slit of the radially outer core 32. At the same time, the peripheral wall portion 44 is held between the bottom cylindrical end portion 18 and the top cylindrical end portion 36. Also, the bent open end 45 contacts the annular corner portion 20, which is a connection between the flange portion 19 and the bottom cylindrical end portion 18. Then, the assembling of the coil member 10 is finished. Thereafter, the plug cap 51 of the high voltage tower member is installed at a bottom end of the coil member 10. In this assembling process, the spring 48 is inserted into the top cylindrical end portion 36 of the coil case 26, and the bottom press-fitting portion 52 of the plug cap 51 is pressed into the holding portion 37, so that a top end of the spring 48 contacts a bottom surface of the base wall portion 41 of the high voltage terminal 40.

Then, the igniter 65 and a terminal 66 are installed in the top case 61. Atop end of the radially outer core 32 and a top portion 28 of the coil case member 26 are pressed into a radially inward side of the top press-fitting portion 63 of the top case 61. Thereafter, the secondary winding 15 and the primary winding 23 are electrically connected with the terminal 66 and the like. Then, from the top case 61, epoxy resin is injected into a space around the igniter 65 of the top case 61. Thereafter, the epoxy resin travels to the coil case 26, whereby the epoxy resin fills a space between the secondary winding 15 and the primary spool 22, and a space between the secondary spool 14 and the top cylindrical end portion 36 of the coil case 26. At this time, a space between the bottom cylindrical end portion 18 of the secondary spool 14 and the top cylindrical end portion 36 of the spring case 35 is communicated, and is filled with the epoxy resin. The epoxy resin is cured when heated, so that the epoxy resin becomes the first dielectric resin 70 of the top case 61 and the second dielectric resin 72 of the coil member 10.

An operational effect will be described. The effect of the stick ignition coil apparatus is widely known and is not directly related to the present invention. Thus, an explanation of the effect of the stick ignition coil apparatus is omitted. According to the present stock ignition coil apparatus, firstly, a crack is not likely to be formed in the second dielectric resin 72 around the open end 45 of the high voltage terminal 40. This is because the open end 45 is bent radially outward beforehand, and thereafter the bent open end 45 contacts the annular corner portion 20, which includes the bottom cylindrical end portion 18 of the secondary spool 14 and the flange portion 19.

Thus, as it is obviously shown in FIGS. 2A and 2B that the open end 45 is slightly bent radially outward. Therefore, stress is not likely to be concentrated on either an outer edge or an inner edge. Also, the second dielectric resin 72 does not substantially exist between the open end 45 and the bottom cylindrical end portion 18, because the open end 45 contacts the outer peripheral surface of the bottom cylindrical end portion 18. Also, because the open end 45 enters at the annular corner portion 20, which is formed by the bottom cylindrical end portion 18 and the flange portion 19, the open end 45 is not likely to detach from the bottom cylindrical end portion 18. Therefore, a boundary surface is not likely to be generated.

As a second operational effect, because the coil case member 26 and the spring case member 35 are formed integrally, it is easy to mould a case 25. As a third operational effect, because the base wall portion 41 of the high voltage terminal 40 includes the conic projection 42, which is injected into the cavity of the bottom cylindrical end portion 18, the high voltage terminal 40 is accurately positioned.

Figure 3:
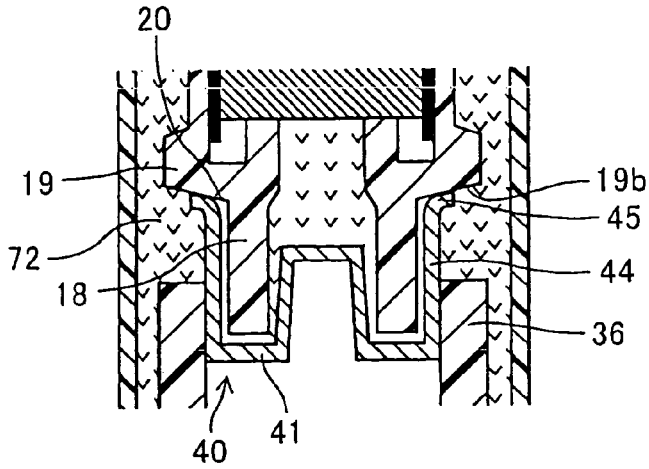
FIG. 3 is a sectional view of a main part of a first modification of the first embodiment.
Figure 4:
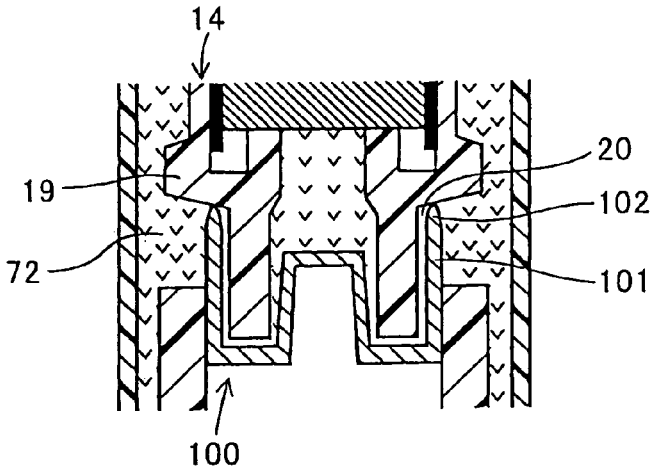
FIG. 4 is a sectional view of a main part of a second modification of the first embodiment.
Figure 5:
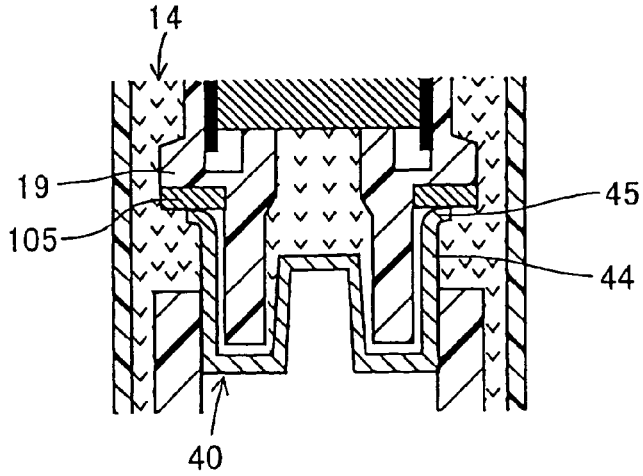
FIG. 5 is a sectional view of a main part of a third modification of the first embodiment.

FIGS. 3, 4 and 5 are modifications of the first embodiment. In a first modification as shown in FIG. 3, on the flange portion 19 at the bottom portion 17 of the second spool 14, the annular projection 19*a*, which is formed in the first embodiment, is not formed. Instead, a bottom surface of the flange portion 19 is an annular inclined plane 19*b*. The open end 45 of the peripheral wall portion 44 of the high voltage terminal 40 contacts the annular corner portion 20 at a root of the annular inclined plane 19*b*. Other structure is the same as the first embodiment.

In a second modification as shown in FIG. 4, an open end 102 of a peripheral wall portion 101 of the high voltage terminal 100 is tapered and contacts the bottom surface of the flange portion 19. In this structure, the open end 102 has only one edge, which contacts the bottom surface of the flange portion 19. Thus, the crack is not likely to be upwardly generated in the second dielectric resin 72.

In a third modification as shown in FIG. 5, an inner edge of the open end 45, which is bent radially outward, of the peripheral wall portion 44 of the high voltage terminal 40 contacts an annular plate 105. The annular plate 105 is composed of a soft material, which is softer than the secondary spool 14. The annular plate 105 is pressed toward the bottom surface of the flange portion 19. By this structure, the inner edge is slightly engaged in the annular plate 105, and the second dielectric resin 72 does not substantially exist around the inner edge. Therefore, the crack is not likely to be generated.

(Second Embodiment)

A second embodiment of the present invention will be described with reference to the accompanying drawings. Similar components of a stick ignition coil apparatus of the present embodiment, which are similar to the components of the stick ignition coil apparatus of the first embodiment, will be indicated by the same numerals.

Figure 6:
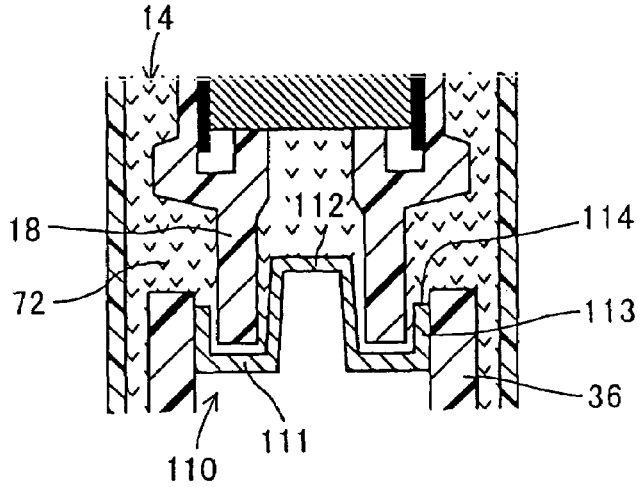
FIG. 6 is a sectional view of a main part of the stick ignition coil apparatus according to a second embodiment.

In the second embodiment, the open end of the outer peripheral wall portion contacts the top cylindrical end portion of the spring case. As shown in FIG. 6, the secondary spool 14 has almost the same structure as the first embodiment. At a center of a base wall portion 111 of a high voltage terminal 110, a projection 112, which projects toward the same direction (upward in FIG. 6) as a peripheral wall portion 113 extends, is formed. The height (deepness) of the projection 112 is larger than the height of the peripheral wall portion 113. An outer peripheral surface of the peripheral wall portion 113 is engaged with an inner peripheral surface of the top cylindrical end portion 36. A top end of the top cylindrical end portion 36 extends toward the top end of the stock ignition coil apparatus further than an open end 114. Here, there is a slight space between the projection 112 and the bottom cylindrical end portion 18, which is included in the distal projecting portion of the secondary spool 14.

In the second embodiment, an outer edge of the open end 114 of the high voltage terminal 110 contacts the inner peripheral surface of the top cylindrical end portion 36. Thus, the second dielectric resin 72 does not substantially exist therebetween. Thus, the crack is not likely to be generated in the second dielectric resin 72 around the open end 45. Also, an inner edge of the open end 114 is located adjacent to an outer peripheral surface of the bottom cylindrical end portion 18 of the secondary spool 14. Therefore, the crack is not likely to be generated.

Figure 7:
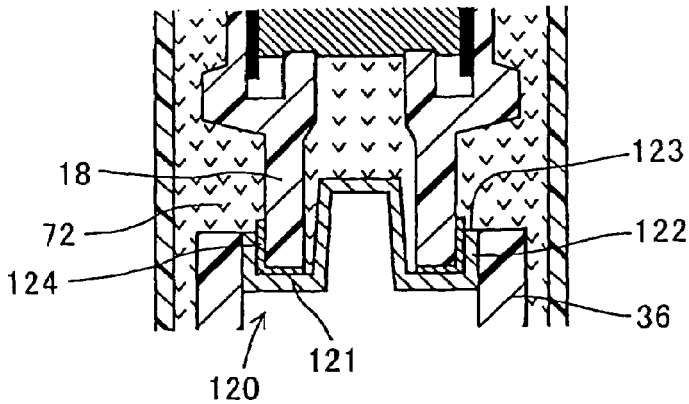
FIG. 7 is a sectional view of a main part of a first modification of the second embodiment.

In FIGS. 7 to 13, modifications of the second embodiment are described. In a first modification as shown in FIG. 7, the peripheral wall portion 122 of a high voltage terminal 120 is engaged with the top cylindrical end portion 36 of the spring case 35. An open end 123 is at the same position as a top end of the top cylindrical portion 36, and an outer edge of the open end 123 contacts the top cylindrical end portion 36. An annular intermediate component 124, a section of which forms L shape, lies between a bottom surface of the bottom cylindrical end portion 18 and a base wall portion 121 of a high voltage terminal 120, and lies between an outer peripheral surface of a bottom part of the bottom cylindrical end portion 18 and a peripheral wall portion 122 of the high voltage terminal 120. An inner edge of the open end 123 contacts an outer peripheral surface of the intermediate component 124. An outer edge of the open end 123 contacts the top cylindrical end portion 36, and the inner edge of the open end 123 contacts the intermediate component 124. Therefore, the crack is not likely to be generated on the second dielectric resin 72.

Figure 8:
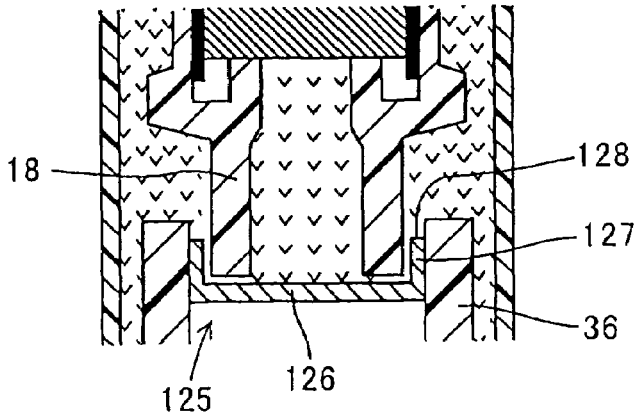
FIG. 8 is a sectional view of a main part of a second modification of the second embodiment.
Figure 9:
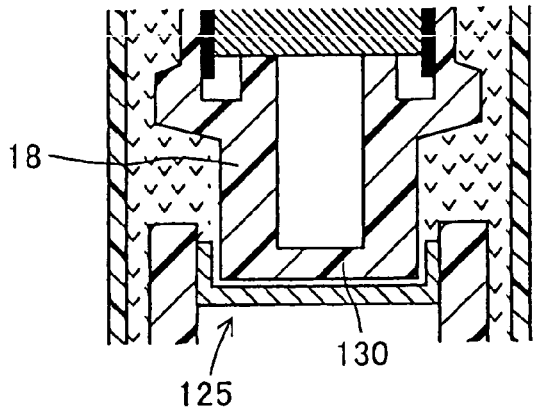
FIG. 9 is a sectional view of a main part of a third modification of the second embodiment.

In a second modification as shown in FIG. 8, a high voltage terminal 125 includes a base wall portion 126 and a peripheral wall portion 127. Neither a recess portion nor a projection is formed on a surface of the flat base wall portion 126. The peripheral wall portion 127 is engaged with an inner peripheral surface of the top cylindrical end portion 36 of the spring case 35. An outer edge of an open end 128 contacts an inner peripheral surface of the top cylindrical end portion 36. An inner edge of the open end 128 contacts an outer peripheral surface of the bottom cylindrical end portion 18. As shown in a third modification in FIG. 9, a base portion 130 may be formed at a bottom end of the bottom cylindrical end portion 18 of the secondary spool 14.

Figure 10:
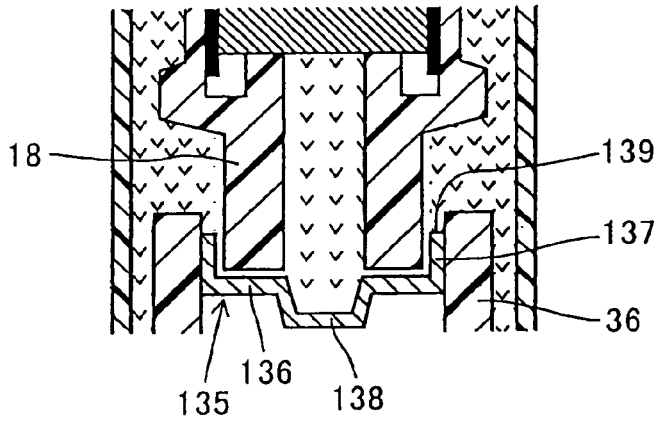
FIG. 10 is a sectional view of a main part of a fourth modification of the second embodiment.
Figure 11:
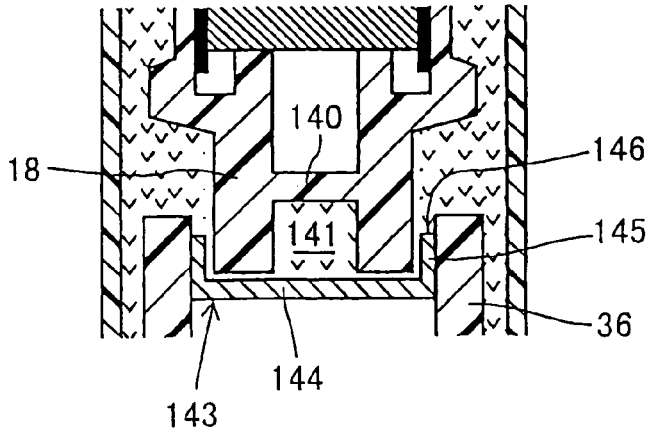
FIG. 11 is a sectional view of a main part of a fifth modification of the second embodiment.

In a fourth modification as shown in FIG. 10, a high voltage terminal 135 includes a base wall portion 136 and a peripheral wall portion 137. At a center of the base wall portion 136, a projection 138 is projected in an opposite direction (downward in FIG. 10) from the direction of the peripheral wall portion 137. An outer edge of an open end 139 of the peripheral wall portion 137 contacts an inner peripheral surface of the top cylindrical end portion 36. In an inner edge of the open end 139 is located closer to an outer peripheral surface of the bottom cylindrical end portion 18 of the secondary spool 14. In a fifth modification as shown in FIG. 11, a base portion 140 is formed at a slightly upper side of the bottom end of the bottom cylindrical end portion 18 of the secondary spool 14. Below the base portion 140, a cavity 141 of the bottom cylindrical end portion 18 is formed. A high voltage terminal 143 includes a base wall portion 144 and a peripheral wall portion 145. The peripheral wall portion 145 is held by the top cylindrical end portion 36 of the spring case 35. An open end 146 contacts the inner peripheral surface of the top cylindrical end portion 36.

Figure 12:
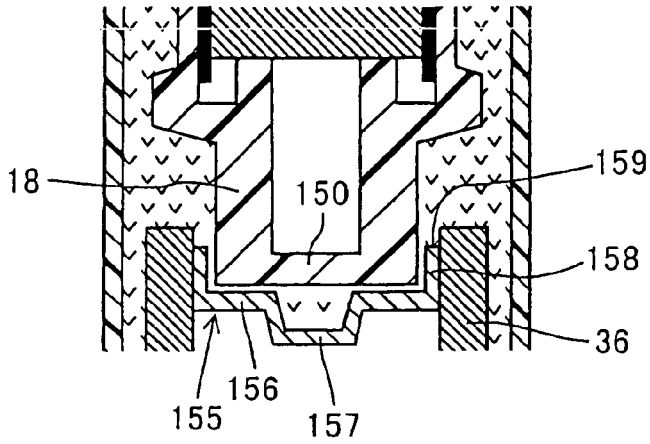
FIG. 12 is a sectional view of a main part of a sixth modification of the second embodiment.
Figure 13:
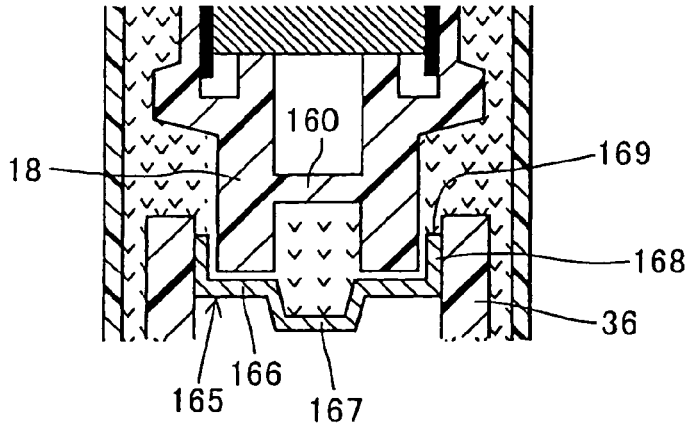
FIG. 13 is a sectional view of a main part of a seventh modification of the second embodiment.

In a sixth modification as shown in FIG. 12, a base portion 150 is formed at a bottom end of the bottom cylindrical end portion 18 of the secondary spool 14. A peripheral wall portion 158 of a high voltage terminal 155 is held by the top cylindrical end portion 36 of the spring case 35. On a base wall portion 156 of the high voltage terminal 155, a projection 157, which projects downward, is formed integrally. An open end 159 contacts the inner peripheral surface of the top cylindrical end portion 36. Also, in a seventh modification as shown in FIG. 13, a base portion 160 is formed at a mid-point of the bottom cylindrical end portion 18 of the secondary spool 14. A peripheral wall portion 168 of a high voltage terminal 165 is held by the top cylindrical end portion 36 of the spring case 35. On a base wall portion 166 of the high voltage terminal 165, a projection 167, which projects downward, is formed integrally. An open end 169 contacts the inner peripheral surface of the top cylindrical end portion 36.

The first to seventh modifications achieve the same effect as the second embodiment.

(Third Embodiment)

A third embodiment of the present invention will be described with reference to the accompanying drawings. Similar components of a stick ignition coil apparatus of the present embodiment, which are similar to the components of the stick ignition coil apparatus of the first embodiment, will be indicated by the same numerals.

Figure 14:
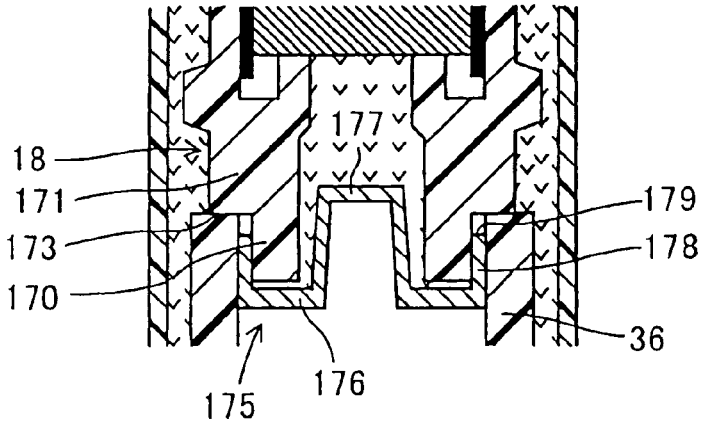
FIG. 14 is a sectional view of a main part of the stick ignition coil apparatus according to a third embodiment.

In the third embodiment as shown in FIG. 14, the open end of the outer peripheral wall portion of the high voltage terminal is encircled by a bottom end of the secondary spool and a top end of the spring case. In other words, the dielectric resin around the open end is closed by the bottom end of the secondary spool and the top end of the spring case. This means that an outer diameter of a bottom half portion 170 of the bottom cylindrical end portion 18, which is included in the distal projecting portion of the secondary spool 14, of the secondary spool 14 is smaller than an outer diameter of a top half portion 171 of the bottom cylindrical end portion 18. Thus, an annular step portion 173 is formed therebetween.

A peripheral wall portion 178 of a high voltage terminal 175 is engaged with an outer peripheral surface of the bottom half portion 171, and also is engaged with the top cylindrical end portion 36 of the spring case 35. An open end 179 of the peripheral wall portion 178 is located slightly away from the step portion 173. A projection 177 of a base wall portion 176 is projected into the cavity of the bottom cylindrical end portion 18. The top cylindrical end portion 36 of the spring case 35 is engaged with an outer peripheral surface of the peripheral wall portion 178. A top end of the top cylindrical end portion 36 contacts the step portion 173.

In the third embodiment, the open end 179 and the second dielectric resin 72 therearound are encircled by the bottom half of the bottom cylindrical end portion 18, the step portion 173 and the top cylindrical end portion 36. Therefore, the crack, which starts from outer and inner edges of the open end 179, is limited from being generated.

Figure 15:
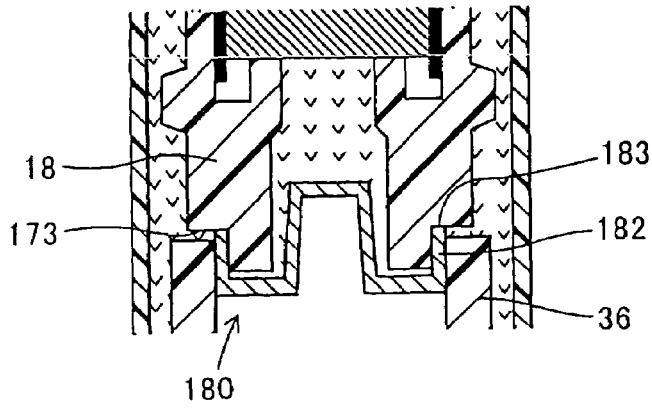
FIG. 15 is a sectional view of a main part of a modification of the third embodiment.

In a modification of the third embodiment as shown in FIG. 15, there is a space (no contact) between the step portion 173 of the bottom cylindrical end portion 18 of the secondary spool 14 and the top cylindrical end portion 36 of the spring case 35. An open end 183 of a peripheral wall portion 182 of a high voltage terminal 180 contacts the step portion 173. The top cylindrical end portion 36 of the spring case 35 is engaged with an outer peripheral surface of the peripheral wall portion 182.

(Fourth Embodiment)

A fourth embodiment of the present invention will be described with reference to the accompanying drawings. Similar components of a stick ignition coil apparatus of the present embodiment, which are similar to the components of the stick ignition coil apparatus of the first embodiment, will be indicated by the same numerals.

Figure 16:
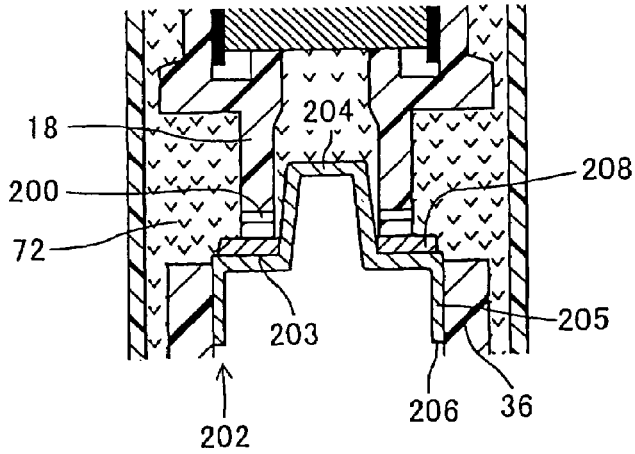
FIG. 16 is a sectional view of a main part of the stick ignition coil apparatus according to a fourth embodiment.

The fourth embodiment is described in FIG. 16. In the present embodiment, the high voltage terminal includes a first terminal element, which is shaped into a tubular form, and an annular second terminal element. An opening of the first terminal element faces downward. Specifically, at a bottom side of the bottom cylindrical end portion 18, which is included in the distal projecting portion of the secondary spool 14, of the secondary spool 14, a circulation hole 200 for epoxy resin is formed in the radial direction. The first terminal element 202 includes a base wall portion 203 and a peripheral wall portion 205. At a center of the base wall portion 203, a projection 204 is projected in an opposite direction from the extending direction of the peripheral wall portion 205.

An outer peripheral surface of the projection 204 is loosely engaged with an inner peripheral surface of the bottom cylindrical end portion 18. An outer peripheral surface of the peripheral wall portion 205 is engaged with the top cylindrical end portion 36 of the spring case 35. The annular second terminal element 208 lies between a base wall portion 203 and a bottom end of the bottom cylindrical end portion 18. An inner diameter of the annular second terminal element 208 is slightly larger than an outer diameter of the projection 204. Also, an outer diameter of the annular second terminal element 208 is slightly smaller than the outer diameter of the peripheral wall portion 205.

The bottom end of the bottom cylindrical end portion 18 contacts a top surface of the second terminal element 208. Therefore, the epoxy resin does not circulate between an inside and an outside of the secondary spool 14. Thus, the epoxy resin circulates through the circulation hole 200.

In the fourth embodiment, an opening of the peripheral wall portion 205 of the first terminal element 202, which is shaped into a tubular form, faces downward. Thus, around an open end 206, the dielectric resin 72 does not exist substantially. Therefore, the crack, which starts from an edge of the open end 206, is not likely to be generated. Also, an outer rim of the second terminal element 208 contacts the base wall portion 203 of the first terminal element 202. Thus, the crack is not likely to be generated in the second dielectric resin 72 therearound.

Modifications of the fourth embodiment will be described. In a first modification of the fourth embodiment, the circulation hole 200, which is formed in the bottom cylindrical end portion 18 of the secondary spool 14, may be alternatively located in an upper side of a middle part of the bottom cylindrical end portion 18. Therefore, the circulation hole 200 may be alternatively located in an upper side than a top end of the projection 204.

Figure 17:
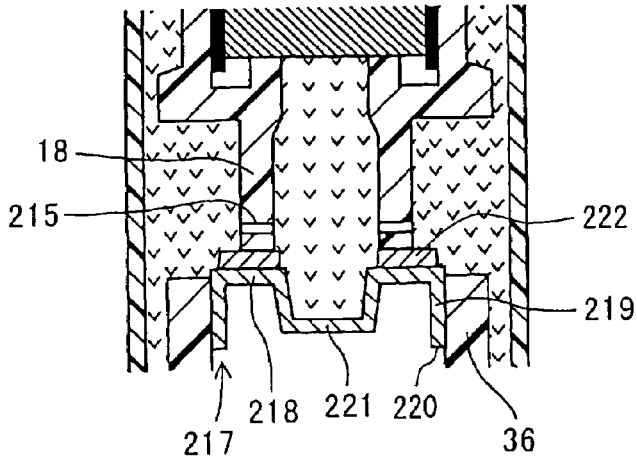
FIG. 17 is a sectional view of a main part of a second modification of the fourth embodiment.
Figure 18:
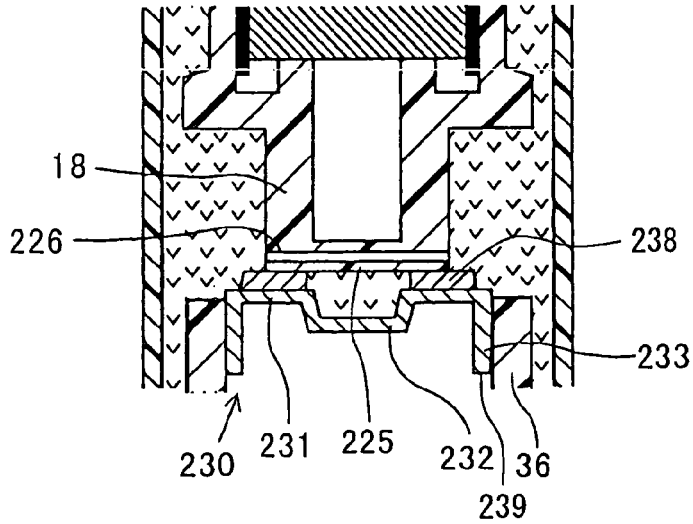
FIG. 18 is a sectional view of a main part of a third modification of the fourth embodiment.

In a second modification as shown in FIG. 17, a circulation hole 215 is formed in the bottom side of the bottom cylindrical end portion 18 of the secondary spool 14. At a center of a base wall portion 218 of a first terminal element 217, a projection 221 is projected in the same direction as an extending direction of a peripheral wall portion 219 (downward in FIG. 17). The peripheral wall portion 219 is engaged with the top cylindrical end portion 36 of the spring case 35. In a third modification as shown in FIG. 18, the secondary spool 14 includes a base portion 225 at a bottom end of the bottom cylindrical end portion 18. A circulation hole 226 is formed in the base portion 225 in a radial direction. A first terminal element 230 includes a peripheral wall portion 233 and a base wall portion 231, which is equipped with a low projection 232, which projects downward.

Figure 19:
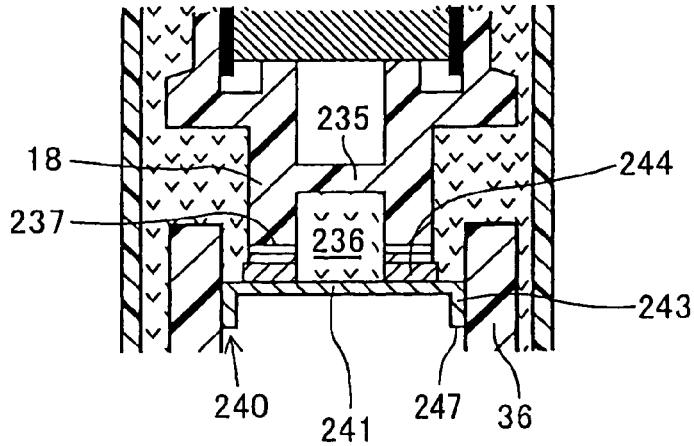
FIG. 19 is a sectional view of a main part of a fourth modification of the fourth embodiment.

In a fourth modification as shown in FIG. 19, the secondary spool 14 includes a base wall portion 235 at an upper side of a bottom end of the bottom cylindrical end portion 18. Bellow the base wall portion 235A, a cavity 236 of the bottom cylindrical end portion 18 is formed. A circulation hole 237 is formed in a radial direction near the bottom end of the bottom cylindrical end portion 18. A first terminal element 240 includes a base wall portion 241 and a peripheral wall portion 243, which is engaged with the top cylindrical end portion 36 of the spring case 35. A second terminal element 244 lies between the base wall portion 241 and a bottom end of the bottom cylindrical end portion 18.

Figure 20:
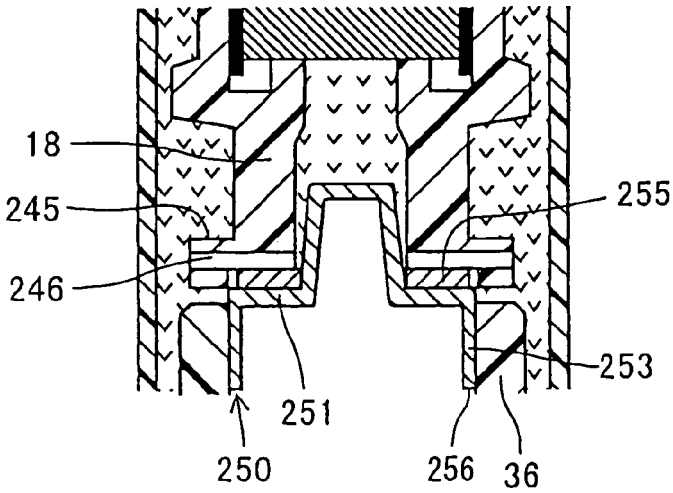
FIG. 20 is a sectional view of a main part of a fifth modification of the fourth embodiment.

In a fifth modification as shown in FIG. 20, a circulation hole 246 is formed in a radial direction at a flange portion 245, which is formed at a bottom end of the bottom cylindrical end portion 18 of the secondary spool 14. A peripheral wall portion 253 of a first terminal element 250 is engaged with the top cylindrical end portion 36 of the spring case 35. An outer diameter of a second terminal element 255 is smaller than an outer diameter of a base wall portion 251 of the first terminal element 250. An outer rim of the second terminal element 255 is encircled by the flange portion 245 of the secondary spool 14.

Figure 21:
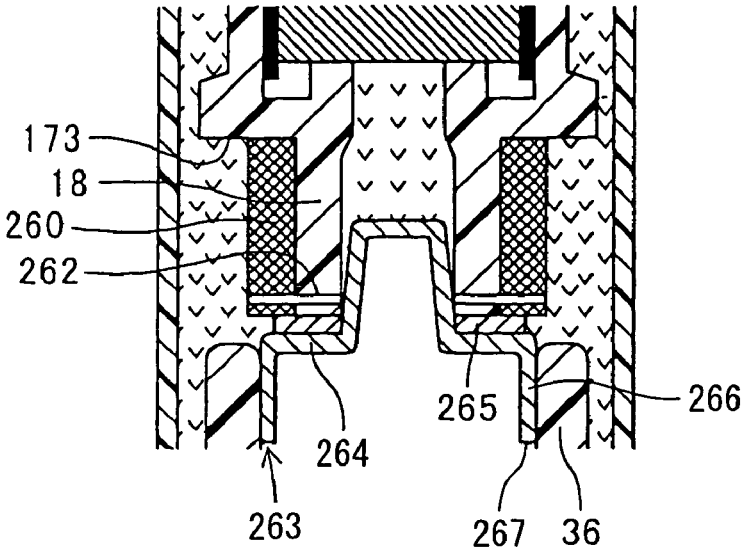
FIG. 21 is a sectional view of a main part of a sixth modification of the fourth embodiment.

In a sixth modification as shown in FIG. 21, a sleeve 260 is engaged with an outer peripheral surface of the bottom cylindrical end portion 18 of the secondary spool 14. A top end of the sleeve 260 contacts the step portion 173 and the bottom end of the sleeve 260 is leveled with the bottom cylindrical end portion 18. A circulation hole 262 is formed in the bottom cylindrical end portion 18 and the sleeve 260. A second terminal element 265 lies between a first terminal element 263 and the sleeve 260. An outer diameter of the second terminal element 265 is selected in a rage between outer diameters of the bottom cylindrical end portion 18 and the sleeve 260. A top edge of an outer rim of the second terminal element contacts the sleeve 260, and a bottom edge of the outer rim of the second terminal element contacts a base wall portion 264.

Figure 22:
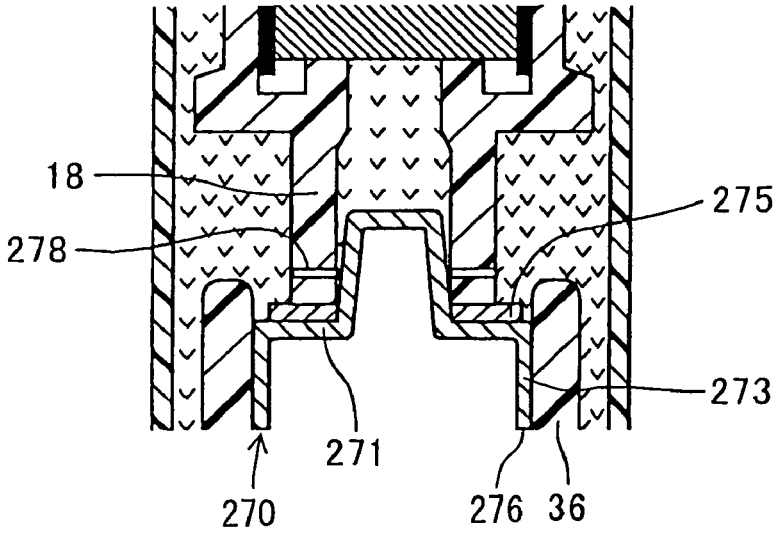
FIG. 22 is a sectional view of a main part of a seventh modification of the fourth embodiment.
Figure 23A:
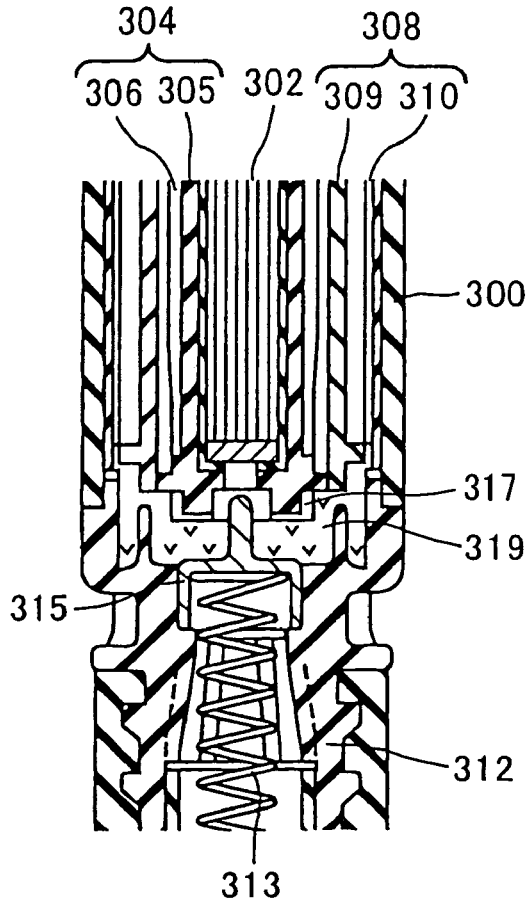
FIG. 23A PRIOR ART
FIG. 23A is a longitudinal sectional view of a conventional stick ignition coil apparatus.
Figure 23B:
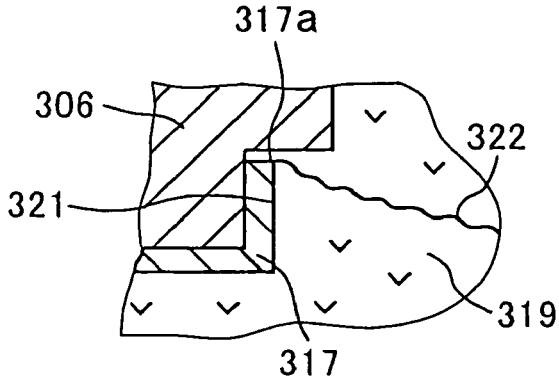
FIG. 23B PRIOR ART
FIG. 23B is a schematic view of FIG. 23A.

In a seventh modification as shown in FIG. 22, a circulation hole 278 is formed in the bottom end of the bottom cylindrical end portion 18 of the secondary spool 14. A peripheral wall portion 273 of a first terminal element 270 is engaged with the top cylindrical end portion 36 of the spring case 35. The top cylindrical end portion 36 extends upward further than a second terminal element 275. The second terminal element 275 lies between a bottom end of the bottom cylindrical end portion 18 and a base wall portion 271. A bottom edge of an outer rim of the second terminal element 275 contacts the base wall portion 271, and a top edge of the outer rim of the second terminal element 275 is located adjacent to a top end of the top cylindrical end portion 36:

The first to seventh modifications achieve the same effect as the fourth embodiment.

Additional advantages and modifications will readily occur to those skilled in the art. The invention in its broader terms is therefore not limited to the specific details, representative apparatus, and illustrative examples shown and described.

What is claimed is:

1. A stick ignition coil apparatus for an ignition plug, comprising:

a primary coil arrangement, which includes a primary winding and a primary spool, wherein the primary winding is wound around the primary spool;

a secondary coil arrangement, which is located radially inward of the primary coil arrangement, wherein:

the secondary coil arrangement includes a secondary winding and a secondary spool;

the secondary winding is wound around the secondary spool; and an annular corner portion is formed on a distal projecting portion of the secondary spool;

a center core, which is located radially inward of the secondary coil arrangement;

a coil case, which is located radially outward of the primary coil arrangement;

a high voltage terminal, which is located at a distal end of the secondary coil arrangement, wherein:

the high voltage terminal is shaped into a tubular form, an opening of which faces toward a proximal end of the stick ignition coil apparatus; and the high voltage terminal is electrically connected with one end of the secondary winding;

a spring case, which holds a spring for electrically connecting the high voltage terminal with the ignition plug; and dielectric resin, which is filled in a space defined radially inward of the coil case, wherein an open end of the high voltage terminal is directly connected to the annular corner portion of the distal projecting portion of the secondary spool.

2. The stick ignition coil apparatus according to claim 1, wherein the open end of the high voltage terminal is formed as one of a radially outwardly bent open end and an axially tapered open end.

3. The stick ignition coil apparatus according to claim 2, wherein:

the distal projecting portion includes a distal cylindrical end portion; and the distal cylindrical end portion includes a flange portion, in which the annular corner portion is formed.

4. The stick ignition coil apparatus according to claim 3, wherein the coil case and the spring case are formed integrally.

5. A stick ignition coil apparatus for an ignition plug, comprising:

a primary coil arrangement, which includes a primary winding and a primary spool, wherein the primary winding is wound around the primary spool;

a secondary coil arrangement, which is located radially inward of the primary coil arrangement, wherein:

the secondary coil arrangement includes a secondary winding and a secondary spool; and the secondary winding is wound around the secondary spool;

a center core, which is located radially inward of the secondary coil arrangement;

a coil case, which is located radially outward of the primary coil arrangement;

a spring case, which is located at a distal side of the coil case, wherein the spring case holds a spring, one end of which contacts the ignition plug to form an electrical connection therebetween;

a high voltage terminal, which is located at a proximal end of a proximal cylindrical end portion of the spring case, wherein:

the high voltage terminal is shaped into a tubular form, an opening of which faces toward a proximal end of the stick ignition coil apparatus;

the high voltage terminal is electrically connected with one end of the secondary winding; and the high voltage terminal contacts the other end of the spring to form an electrical connection therebetween; and dielectric resin, which is filled in a space defined radially inward of the coil case, wherein an open end of the high voltage terminal contacts an inner peripheral surface of the proximal cylindrical end portion of the spring case.

6. The stick ignition coil apparatus according to claim 5, wherein the open end of the high voltage terminal is located on a distal side of the proximal end of the proximal cylindrical end portion of the spring case.

7. The stick ignition coil apparatus according to claim 5, further comprising an intermediate component, which is installed on a distal projecting portion of the secondary spool, wherein the open end of the high voltage terminal contacts an outer peripheral surface of the intermediate component.

8. The stick ignition coil apparatus according to claim 6, wherein the coil case and the spring case are formed integrally.

9. A stick ignition coil apparatus for an ignition plug, comprising:

a primary coil arrangement, which includes a primary winding and a primary spool, wherein the primary winding is wound around the primary spool;

a secondary coil arrangement, which is located radially inward of the primary coil arrangement, wherein:

the secondary coil arrangement includes a secondary winding and a secondary spool; and the secondary winding is wound around the secondary spool;

a center core, which is located radially inward of the secondary coil arrangement;

a coil case, which is located radially outward of the primary coil arrangement;

a spring case, which is located at a distal side of the coil case, wherein:

the spring case holds a spring, one end of which contacts the ignition plug to form an electrical connection therebetween; and a proximal cylindrical end portion of the spring case is located at a proximal end of the spring case; and a high voltage terminal, which contacts at least one of a distal end of the secondary coil arrangement and the proximal end of the spring case, wherein:

the high voltage terminal is shaped into a tubular form, an opening of which faces toward a proximal end of the stick ignition coil apparatus;

the high voltage terminal is electrically connected with one end of the secondary winding; and the high voltage terminal contacts the other end of the spring to form an electrical connection therebetween; and dielectric resin, which is filled in a space defined radially inward of the coil case, wherein an open end of the high voltage terminal is surrounded by a distal projecting portion of the secondary spool and the proximal cylindrical end portion of the spring case.

10. The stick ignition coil apparatus according to claim 9, wherein the open end of the high voltage terminal is held between the distal projecting portion of the secondary spool and the proximal cylindrical end portion of the spring case.

11. The stick ignition coil apparatus according to claim 9, wherein:

an annular step portion is formed in the distal projecting portion of the secondary spool;

the annular step portion faces toward a distal end of the stick ignition coil apparatus;

the open end of the high voltage terminal contacts the annular step portion; and a proximal end of the proximal cylindrical end portion of the spring case is located adjacent to the open end of the high voltage terminal.

12. The stick ignition coil apparatus according to claim 10, wherein the coil case and the spring case are formed integrally.

13. A stick ignition coil apparatus for an ignition plug, comprising:

a primary coil arrangement, which includes a primary winding and a primary spool, wherein the primary winding is wound around the primary spool;

a secondary coil arrangement, which is located radially inward of the primary coil arrangement, wherein:

the secondary coil arrangement includes a secondary winding and a secondary spool; and the secondary winding is wound around the secondary spool;

a center core, which is located radially inward of the secondary coil arrangement;

a coil case, which is located radially outward of the primary coil arrangement;

a spring case, which is located at a distal side of the coil case, wherein the spring case holds a spring, one end of which contacts the ignition plug to form an electrical connection therebetween;

a high voltage terminal, which is located on a proximal end of the spring case, wherein:

the high voltage terminal is shaped into a tubular form, an opening of which faces toward a distal end of the stick ignition coil apparatus;

the high voltage terminal is electrically connected with one end of the secondary winding; and the high voltage terminal includes a first terminal element, which contacts the other end of the spring to form an electrical connection therebetween; and dielectric resin, which is filled in a space defined radically inward of the coil case, wherein an open end of the high voltage terminal is located in a space, which is not filled with the dielectric resin, wherein:

the first terminal element of the high voltage terminal includes a base wall portion;

the high voltage terminal further includes a second terminal element, which lies between the base wall portion of the first terminal element and a distal projecting portion of the secondary spool;

the second terminal element is shaped into an annular form; and an outer rim of the second terminal element is located between the distal projecting portion of the secondary spool and the base wall portion of the first terminal element.

14. The stick ignition coil apparatus according to claim 13, wherein the first terminal element includes a peripheral wall portion, which is held by an inner peripheral surface of a proximal cylindrical end portion of the spring case.

15. The stick ignition coil apparatus according to claim 13, wherein a proximal end of the proximal cylindrical end portion of the spring case extends toward a proximal end of the stick ignition coil apparatus further than the second terminal element.

16. The stick ignition coil apparatus according to claim 15, wherein the coil case and the spring case are formed integrally.

* * * * *